US005852350A

United States Patent [19]

LeVoir

[11] Patent Number: 5,852,350

[45] Date of Patent: Dec. 22, 1998

[54] RAILROAD CROSSING GATE CONTROL SYSTEM INCLUDING A SEPARATE MAINTENANCE RELAY

[75] Inventor: Donald L. LeVoir, Coon Rapids, Minn.

[73] Assignee: Safetran Systems Corporation, Minneapolis, Minn.

[21] Appl. No.: 994,386

[22] Filed: Dec. 19, 1997

Related U.S. Application Data

[63] Continuation-in-part of Ser. No. 924,897, Sep. 8, 1997.

[51] Int. Cl.[6] ..... H02P 7/00

[52] U.S. Cl. ..... 318/466; 318/281; 246/125

[58] Field of Search ..... 318/376, 466–472, 318/266, 280–286; 246/125

[56] References Cited

U.S. PATENT DOCUMENTS

| | | | |
|---|---|---|---|
| 3,601,603 | 8/1971 | Hughson | 246/125 |
| 3,903,191 | 9/1975 | Loderer | 318/376 |
| 3,964,704 | 6/1976 | Karr | 246/125 |
| 3,991,352 | 11/1976 | Fry et al. | 318/759 |
| 4,006,392 | 2/1977 | Catlett et al. | 318/266 |
| 4,090,685 | 5/1978 | Pappas | 246/125 |
| 5,502,367 | 3/1996 | Jones | 318/281 |

*Primary Examiner*—Jonathan Wysocki
*Attorney, Agent, or Firm*—Dorn, McEachran,Jambor & Keating

[57] ABSTRACT

A railroad crossing gate electrical control system for moving a crossing gate in up and down directions also provides for raising the gate counterweights in a failure mode. The control system includes an electric motor having a plurality of electromagnet poles and an armature rotating inside of the poles, with armature movement controlling gate movement. There is a motor and snub relay having contacts connected to the armature and the motor poles. A terminal board has movable contacts which are connected to the motor and snub relay and to a relay coil for moving the contacts of the snub relay. A source of power is connected to the terminal board. The movable terminal board contacts control the application of power to the motor and snub relay coil and the motor and snub relay contacts for operating the motor to cause up and down gate movement. There is a maintenance relay having a coil connected through a normally open switch to the source of power. The maintenance relay has contacts thereof connectable to the source of power and the motor, whereby closure of the normally open switch powers the maintenance relay coil to cause the contacts thereof to directly connect the source of power to the motor to cause the gate counterweights to be raised by armature movement.

7 Claims, 2 Drawing Sheets

Fig. 1.
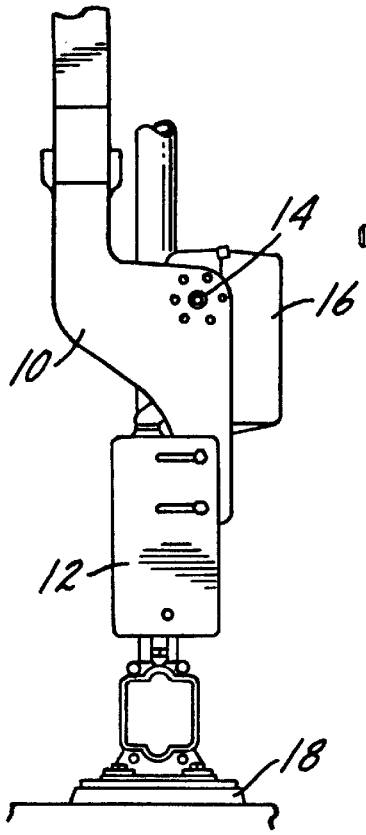
Fig. 2.
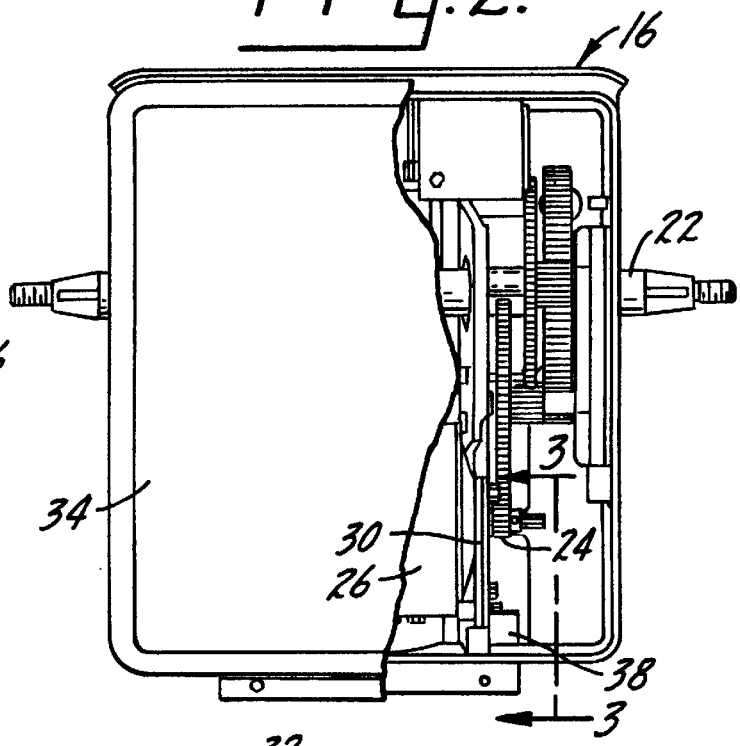
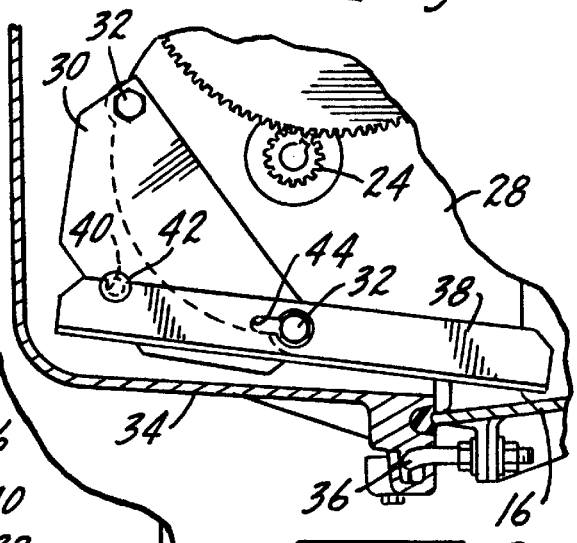
Fig. 3.
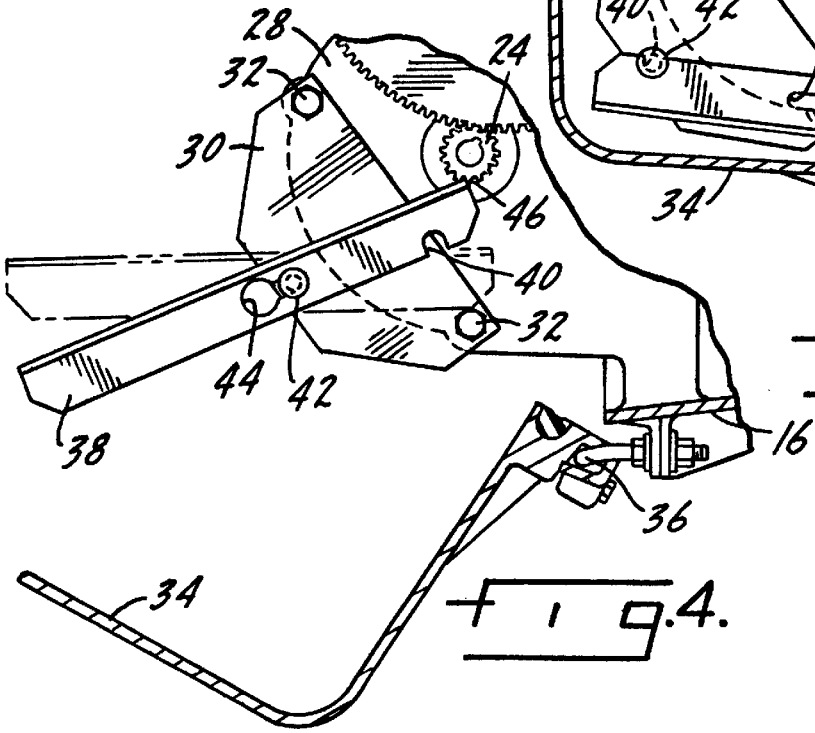
Fig. 4.

RAILROAD CROSSING GATE CONTROL SYSTEM INCLUDING A SEPARATE MAINTENANCE RELAY

This application is a continuation-in-part of application Ser. No. 08/924,897 filed Sep. 8, 1997, entitled "Railroad Crossing Gate Mechanism Control System."

THE FIELD OF THE INVENTION

The present invention relates to a railroad highway crossing gate mechanism and more specifically to a control system which includes both electrical and mechanical elements for both raising and holding the gate counterweights in the event that the gate arm should be broken and the counterweights should be in a down position. In the past, in a failure mode as described, the counterweights are usually raised by some form of mechanical device which requires very substantial effort on the part of maintenance personnel. In the present invention, a maintenance relay has been added to the gate control system with this relay applying power directly to the gate motor in the event of the described failure mode, with the motor then functioning to raise the counterweights. Once the counterweights have been raised, there is provision for a mechanical lock to hold them in this position while maintenance personnel perform the required functions. Further, there is an added safety feature in that the maintenance relay cannot be operated when the normal snubbing relay of the gate control system is powered. Thus, the maintenance relay can only be used under maintenance conditions and when no power is applied to the normal operating circuit of the gate arm control system.

SUMMARY OF THE INVENTION

The present invention relates to a railroad highway crossing gate mechanism and particularly to its control system and more specifically to a control system which includes a maintenance relay for use in raising the gate counterweights in the event that such are in a down position due to a broken gate arm.

Another purpose of the invention is a railroad crossing gate arm control system as described in which the maintenance relay has a normally open switch in circuit between its relay coil and the source of power, with further protection being provided by a maintenance safety relay in circuit with the normally open switch.

Another purpose of the invention is to provide a reliable and efficient electrical and mechanical mechanism for raising and holding the gate arm counterweights of a railroad crossing gate mechanism in the event they are in a failure mode and the counterweights have been lowered.

Other purposes will appear in the ensuing specification, drawings and claims.

BRIEF DESCRIPTION OF THE DRAWINGS

The invention is illustrated diagrammatically in the following drawings wherein:

FIG. 1 is a diagrammatic illustration of a typical railroad highway crossing gate mechanism;

FIG. 2 is an enlarged side view, in part section, of the gate motor and the mechanical elements for raising and lowering the gate;

FIG. 3 is an enlarged section along plane 3—3 of FIG. 2;

FIG. 4 is a diagrammatic illustration of the locking mechanism for holding the counterweights in a raised position.

DESCRIPTION OF THE PREFERRED EMBODIMENT

Figure 5:
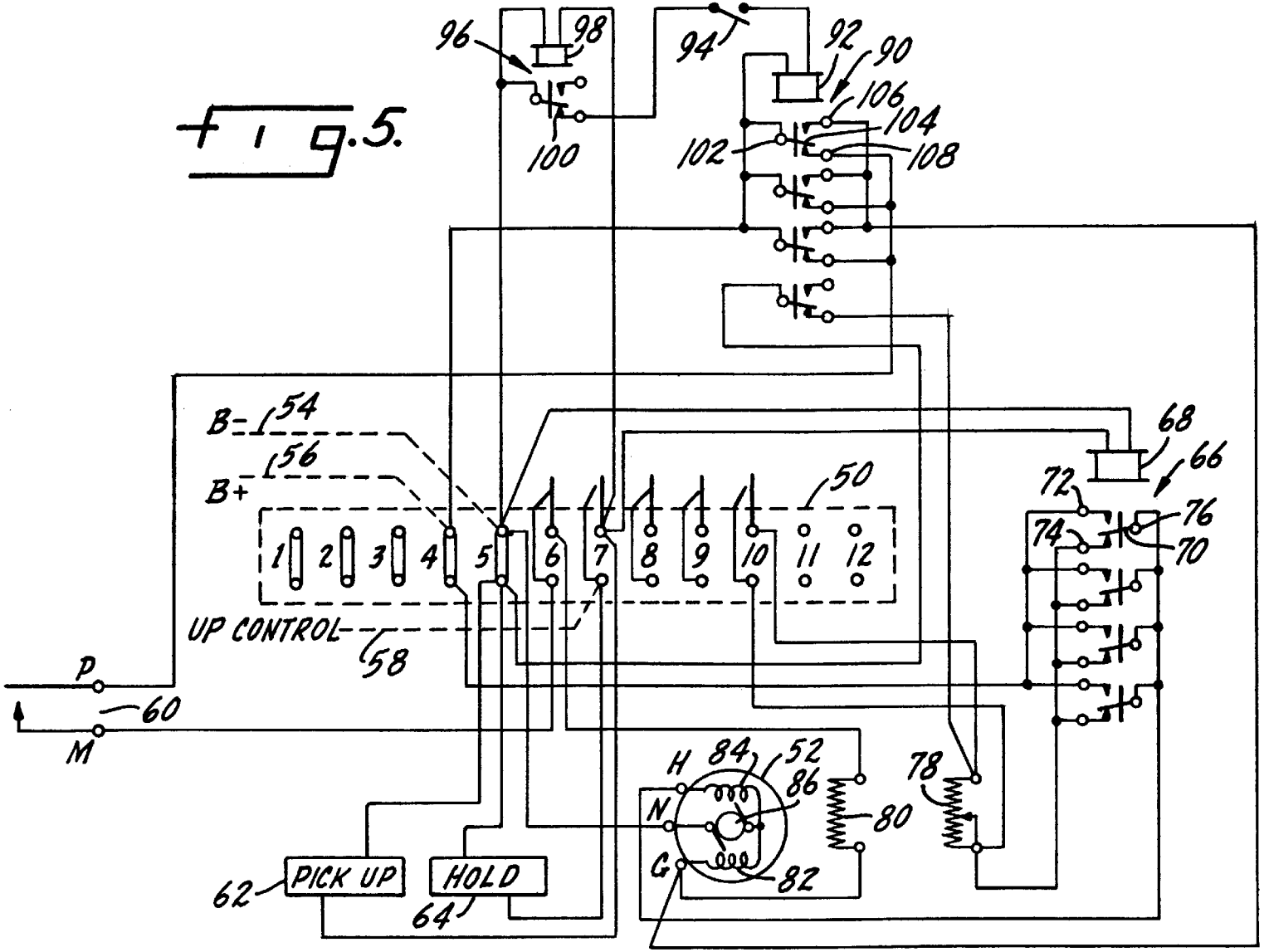
FIG. 5 is a schematic of the control system for the crossing gate mechanism shown and described herein.

Existing railroad highway crossing gate mechanisms use 4 pole/4 field coil or 2 pole/2 field coil series wound or permanent magnet motors and operate in a generally uniform manner using direct current. The present invention will be described in connection with a motor having four series wound field coils. The invention is equally applicable to other types of motors and to motors having a mixture of permanent magnet and series wound field coils.

In typical railroad crossing gate mechanisms, the weight of the arm on the roadway side of the mechanism is offset by heavy counterweights on the opposite or field side. The balance is set at installation to favor the arm side as described by torque requirements in AAR Manual, Part 3.2.15. This insures that the gate will move to a down position whenever there is a power failure. Arm descent is controlled by a motor power down circuit to a 45° position at which time the gate is moved by gravity to a full down position, with the down speed during arm descent being controlled by means of a motor generated snub circuit. Failure modes may take many forms. The present invention is specifically directed to a failure mode resulting from an arm knockdown and subsequent rapid descent of the heavy counterweights. The counterweights may move only to a 45° position in which further lowering of the counterweights is resisted by the motor power down circuit. If there is a loss of power, the counterweights may move to a full down position. The present invention provides an electrical circuit for raising the counterweights, once they are in a down position and power is available to the gate control system. The invention further provides a mechanical stop bar to hold the counterweights in an up position once they have been so moved by the electrical control system.

In FIG. 1 the gate arm is indicated at 10 and the counterweights are indicated at 12. The gate will move about a point of rotation 14 and will be driven by a gate control mechanism and electrical motor with its associated circuit all located within the housing 16. The gate structure will rest upon the conventional concrete pedestal 18.

As shown in FIG. 2, the point of rotation for the gate indicated at 14 in FIG. 1 is a shaft 22. The motor pinion which will rotate the shaft 22 is indicated at 24. The motor and gear housing is indicated at 26 and it will drive the pinion which will in turn cause rotation of the shaft 22 in the appropriate direction to raise or lower the gate.

Focusing on FIG. 3, the motor and gear frame is indicated at 28 with the pinion 24 extending out from the frame. There is a mounting plate 30 attached by bolts 32 to the frame 28 which bolts may be the motor mounting bolts. The cabinet door for the housing 16 is shown at 34 and it will be pivoted to the cabinet frame 16 as at 36. A stop bar is indicated at 38 and FIG. 3 illustrates the unused position of the stop bar. At one end the stop bar has a slot 40 which will be engaged with a pivot lug 42. Centrally located in the stop bar is a key slot 44 which will be used to hold the bar on one of the motor mounting bolts 32.

FIG. 4 illustrates the use of the stop bar 38. Note that the cabinet door 34 is open whereas in FIG. 3 it was closed. In this instance, the control system to be described has raised the counterweights and it is necessary to hold the pinion 24 in this position to maintain the counterweights in a raised condition. The stop bar has been moved from its FIG. 3 position and the end 46 of the stop bar 40 has been inserted between two of the gear teeth of the pinion 24 with the result that the stop bar will prevent rotation of the pinion in a direction to lower the counterweights. Thus the stop bar 38 holds the counterweights in a raised position once they have been so moved by the motor through the use of the control circuit to be described.

In FIG. 5, a terminal board is indicated at 50 and has terminals designated as 1 through 12 with terminals 4, 5, 6, 7 and 10 being pertinent to the present invention and with terminals 6, 7 and 10 having contacts, the operation of which will be described. Terminal 8 is for the flashing light on the gate and terminal 9 is for the gate bell system. Battery power is provided to operate the gate and the battery negative terminal is indicated at 54 and battery positive terminals are indicated at 56 and 58, with the latter terminal being designated as the up terminal. This represents an external control which is closed to apply battery voltage when the gate is raised and opened when the gate is lowered. Power down contacts are indicated at 60, a pickup circuit is indicated at 62 and an up position hold circuit is indicated at 64, both of which are conventional in crossing gate mechanisms.

The motor and snub relay is indicated generally at 66 and includes a relay coil 68 connected to battery negative through terminal 5 and connected to a battery positive terminal through the contacts of terminal 7 on board 50 which as shown in FIG. 5 are open. The contacts for the motor and snub relay, which are shown in the down or non-powered position, consists of four independent contacts, all of which are connected in parallel. Each contact has an arm 70, input terminal 72 and 74 and an output terminal 76. There is a snubbing resistor 78 and a power down resistor 80, with the snubbing resistor being connected to terminal 10 and to the parallel connected input terminal 74 of relay 66. The power down resistor 80 is connected on one side to the G terminal of the two down coils 82 of motor 52, the two up coils being indicated at 84 and the armature being designated at 86. The three terminals for the motor are indicated at G for coil 82, N for the armature 86 and H for coil 84.

A maintenance power relay is indicated generally at 90 and has a coil 92 connected through a normally open switch 94 to a maintenance safety relay 96 having a coil 98 and normally closed contacts 100. The coil 98 of the maintenance safety relay 96 is connected directly to battery negative at terminal 5 of board 50 and will be connected to battery positive through terminal 7 of board 50. The maintenance safety relay is connected in parallel with the coil 68 of the snubbing relay 66. The maintenance relay 90 has a plurality of parallel contacts, with the input terminals being indicated at 102, the contact arms being indicated at 104 and the output terminals being indicated at 106 and 108.

Assuming the gate is in a down position, the contacts of terminal 7 on board 50 will be closed and the contacts of terminal 6 will be open. In this condition, the coil 68 of relay 66 will be connected to battery negative through terminal 5 and to battery positive through the closed contacts of terminal 7, to up control battery positive at 58. Thus, relay 66 will be up and each of the input terminals 72 will be connected to an output terminal 76. With the relay in that position, battery positive at 56 will be connected through relay 66 to the H terminal of coils 84 of motor 52, with the return to battery negative being through the N terminal of armature 86 to terminal 5 of board 50. The motor will operate in the up direction to raise the gate from essentially a zero degree position to approximately 89 degrees or to an almost vertical position. At this point, the contacts of terminal 7 will open and the hold circuit 64 will maintain the gate in its full raised or vertical position. Hold circuit 64 is connected directly across terminals 5 and 7 so that battery power will be applied to the hold clear device to maintain the gate in the up position. Note that when coil 68 is powered as described, coil 98 of maintenance safety relay 96 is also powered, providing an open circuit in the circuit path to coil 92 of maintenance power relay 90. Thus even if switch 94 is closed, the maintenance power relay will not be activated.

When the gate is to be lowered, the power down contacts 60 will be closed and hold clear device 64 opens. The contacts of terminal 6 on board 50 will be closed and the circuit through the contacts of terminal 7 on board 50 will be open. Relay 66 will have dropped to the down position. Battery positive is applied from terminal 6 to power down resistor 80 to coils 82 of motor 52, with the return to battery negative being through the N terminal of armature 86 to terminal 5 of board 50. The gate will be lowered to an approximately 45° position with the last 45 degrees of movement being essentially by gravity with some snubbing being provided by variable resistor 78.

In the event of a failure mode in which the gate's arm is broken and the counterweights have moved down to a 45° position and battery power is still available at the crossing gate, and assuming that no power is being applied to the snubbing relay which would mean no power is applied to the maintenance safety relay 96, the closure of switch 94 by maintenance personnel will cause the contacts of relay 90 to move to the up position which will complete a circuit from battery positive at terminal 4 of board 50, through the contacts of relay 90, to the G terminal or down coils 82 of motor 52, through armature 86 and back to battery negative at terminal 5 of board 50. The armature will thus be driven to move the counterweights in an up direction. Once the counterweights have reached an up position which would be consistent with the arm being in a down position if the arm were on the gate, maintenance personnel will then take the stop bar 38 and move it to the position shown in FIG. 4, locking the pinion against further movement which holds the counterweight in an up position. Maintenance personnel may now make the necessary repairs to the gate arm. The counterweights will have been moved up by power, will be held in an up position by the mechanical locking bar and the gate mechanism can be fully repaired.

The maintenance relay provides an efficient and reliable means for maintenance personnel to raise the very heavy counterweights when the gate is in the failure mode described. The locking bar holds the counterweights in the raised position. However, the maintenance relay cannot be operated if power is applied to the snubbing relay as it would be in the event the gate is being moved in an up direction. Thus the maintenance safety relay provides, as its designation indicates, safety to insure that the raising of the counterweights by the maintenance relay will not be activated or operated or used when the snubbing relay is otherwise powered and the gate arm would be moving.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad crossing gate control system for moving a crossing gate in up and down directions and providing means for raising gate counterweights in a failure mode, said control system including an electric motor having a plurality of electromagnet poles, an armature rotating inside of said poles, with armature movement controlling gate movement, a motor and snub relay having contacts and a coil, the contacts thereof being connected to said armature and said electromagnet poles, a terminal board having movable contacts thereon connected to the motor and snub relay contacts and coil for moving the contacts of said motor and snub relay, a source of power connected to said terminal board, said movable terminal board contacts controlling the application of power to said motor and snub relay coil and said motor and snub relay contacts for operating said motor to cause up and down gate movement, and a normally open switch connected to the source of power, a maintenance relay having a coil connected on one side to said normally open switch and on the other side to said source of power said maintenance relay having contacts thereof connectable to said source of power and to said motor, closure of said normally open switch powering said maintenance relay coil to cause the contacts thereof to directly connect said source of power to said motor.

2. The control system of claim 1 including a maintenance safety relay having a coil and contacts, the contacts of said maintenance safety relay being connected in circuit with said normally open switch.

3. The control system of claim 2 wherein the coil of said maintenance safety relay is connected in parallel with the coil of said motor and snub relay whereby when said motor and snub relay coil is powered, the contacts of said maintenance safety relay open the circuit between said normally open switch and said source of power.

4. The control system of claim 1 wherein all of said electric motor poles are electromagnet poles.

5. The control system of claim 1 further including mechanical means for holding said counterweights in a raised position after being so moved by armature movement.

6. The control system of claim 5 wherein said mechanical means includes a stop bar.

7. The control system of claim 6 wherein said armature mounts a pinion, and wherein said motor has a frame, said stop bar being pivotally mounted on said frame and being engageable with said armature pinion.

* * * * *